US005514917A

United States Patent [19]

Rudy, Jr. et al.

[11] Patent Number: 5,514,917

[45] Date of Patent: May 7, 1996

[54] HEAT DISSIPATING HOUSING FOR CURRENT

[75] Inventors: William J. Rudy, Jr., Annville; Howard R. Shaffer, Millersburg; Daniel E. Stahl, Harrisburg, all of Pa.

[73] Assignee: The Whitaker Corporation, Wilmington, Del.

[21] Appl. No.: 334,180

[22] Filed: Oct. 31, 1994

Related U.S. Application Data

[63] Continuation of Ser. No. 996,762, Dec. 24, 1992, abandoned.

[51] Int. Cl.[6] ..... H01F 13/00

[52] U.S. Cl. ..... 307/104; 336/DIG. 2; 361/689

[58] Field of Search ..... 336/DIG. 2; 363/95; 307/104; 361/688–697, 703

[56] References Cited

U.S. PATENT DOCUMENTS

| | | | |
|---|---|---|---|
| 3,299,964 | 1/1967 | von Recklinghausen | 165/80 |
| 3,697,815 | 10/1972 | Grant et al. | 317/100 |
| 4,156,794 | 5/1979 | Robinson | 174/16 R |
| 4,264,827 | 4/1981 | Herzog | 307/17 |
| 4,331,830 | 5/1982 | Conway et al. | 174/16 R |
| 4,361,861 | 11/1982 | Spapens | 361/391 |
| 4,363,075 | 12/1982 | DeRemer | 361/383 |
| 4,525,769 | 6/1985 | Lehmann | 361/386 |
| 4,557,225 | 10/1985 | Sagues et al. | 123/41.31 |
| 4,587,593 | 5/1986 | Liautaud et al. | 361/383 |
| 4,620,263 | 10/1986 | Ito | 361/383 |
| 4,733,293 | 3/1988 | Gabuzda | 357/81 |
| 4,755,146 | 7/1988 | Rishworth et al. | 439/71 |
| 4,769,557 | 9/1988 | Houf et al. | 307/147 |
| 4,777,560 | 10/1988 | Herrell et al. | 361/384 |
| 4,837,663 | 6/1989 | Zushi et al. | 361/384 |
| 4,838,041 | 6/1989 | Bellows et al. | 62/51.2 |
| 4,840,286 | 6/1989 | Heberling et al. | 220/306 |
| 4,872,102 | 10/1989 | Getter | 363/141 |
| 4,904,879 | 2/1990 | Rudy, Jr. et al. | 307/17 |
| 4,914,551 | 4/1990 | Anschel et al. | 361/389 |
| 4,953,058 | 8/1990 | Harris | 361/383 |
| 5,057,909 | 10/1991 | Mok et al. | 357/81 |
| 5,065,278 | 11/1991 | Schultz | 361/383 |
| 5,065,280 | 11/1991 | Karnezos et al. | 361/386 |
| 5,077,601 | 12/1991 | Hatada et al. | 357/81 |
| 5,089,935 | 2/1992 | Ito | 361/383 |
| 5,105,095 | 4/1992 | Rudy, Jr. et al. | 307/17 |
| 5,117,281 | 5/1992 | Katsuraoka | 357/81 |
| 5,129,594 | 7/1992 | Pease | 244/1 R |
| 5,150,278 | 9/1992 | Lynes et al. | 361/386 |
| 5,241,219 | 8/1993 | LeBaron et al. | 307/104 |

OTHER PUBLICATIONS

*Thermalloy Brochure,* "Semiconductor Accessories", seven pages, (1987); Thermalloy, Inc., Dallas, TX.

*AEEC Letter No. 87–094/SAI–309,* Jul. 17, 1987; pp. 1, 7, 9; Aeronautical Radio Inc., Annapolis, MD.

*AEEC Letter No. 87–122/SAI–313,* Sep. 17, 1987; pp. 1, 38–44; Aeronautical Radio Inc., Annapolis, MD.

*AEEC Letter No. 88–077/SAI–331,* May 20, 1988; pp. 1, 12; Aeronautical Radio Inc., Annapolis, MD.

*Primary Examiner*—William M. Shoop, Jr.
*Assistant Examiner*—Peter Ganjoo
*Attorney, Agent, or Firm*—Anton P. Ness

[57] ABSTRACT

An improved current mode coupler comprising a base (100) and a housing (300) for coupling to conductors (230,231) of a twisted pair cable (22) by at least one pair of opposing E-shaped electromagnets (206,384) mated about the conductors. The coupler base (100) has movable mounting feet (106) and a fixed engaging member (108) and is capable of single-motion mounting to a panel (224). The coupler housing (300) includes an outer shell (314) of thermally conductive material with heat transfer fins (302), a first cavity (316) for securing a pair of E-shaped electromagnets (384) corresponding to E-shaped electromagnets (206) in the coupler base (100), and a second cavity (324) adapted to house therein an electronics package which is connectable to a control unit. Heat transfer fins (302) are oriented diagonally to the housing axes to advantageously utilize ambient air flow for heat dissipation when the coupler is mounted to a panel conventionally parallel to or orthogonal to directions parallel to ambient air currents.

6 Claims, 15 Drawing Sheets

HEAT DISSIPATING HOUSING FOR CURRENT

This application is a Continuation of application Ser. No. 07/996,762 filed Dec. 24, 1992, now abandoned.

FIELD OF THE INVENTION

The present invention relates to the field of electrical connectors and more particularly to a housing for a noninvasive coupler for sensing and transmitting electrical signals from a conductor wires of a twisted pair cable of a data bus.

BACKGROUND OF THE INVENTION

Non-invasive data current mode couplers are planned to be used extensively aboard aircraft for transmitting signals from conductive wires of a twisted pair cable of a data bus. A current mode coupler typically includes a base to which is secured a housing to form an assembly for noninvasive coupling to a twisted pair of signal conductor wires of a closed loop data bus to read signals being transmitted therealong by a series of electromagnetic cores interlaced with loops of the twisted pair. The electromagnetic cores comprise pairs of opposing unique E-shaped electromagnets each member of which is disposed within one or the other of the base or housing. Opposing end faces of the legs of the E-shaped electromagnets engage each other by a resilient bias means after portions of the individual wires of the twisted pair of digital conductor wires at a selected location therealong are placed in formed twisted pair channels of a wire nest extending between the legs of the electromagnets in the base, so that one loop of the twisted pair cable is disposed in the wire nest.

The electronics housing includes an electronics package electrically connected to an electronic subassembly connected to a circuit board element. In turn, the electronic subassembly is electrically connectable at a connector interface of the housing with a cable assembly which extends to a corresponding control unit, with the control unit providing electrical power to the electronic subassembly as well as signal and ground connection. The current mode coupler also can transmit and amplify signals therealong by generating an appropriate electromotive force via an electromagnetic field, and also receive and therefore verify the signal it transmits.

For example, U.S. Pat. No. 5,105,095 describes a data coupler insert having conductive wires positioned within arcuate channels in the top surface of an elastomeric body in the coupler base formed to include channel intersections proximate cable exits adapted for accommodation of crossovers of the conductor wires at ends of a single loop of the cable, with one channel portion being a conductor diameter deeper than the other. Electromagnetic shielding by using metallic plating on the housing provides EMI/RFI protection. A resilient spring means biases the electromagnetic insert so as to bias together each electromagnet pair to form an electromagnetic core. Sealing means are used to position and seal the conductive wires in the assembly. A mounting means secures the coupler base to a panel, as also described in U.S. Pat. No. 5,112,247, and aligning means precisely secures the housing of the data coupler assembly to the base.

U.S. Pat. No. 4,904,879 describes a data current mode coupler, and method of making and assembling the coupler, for receiving signals from a conductor wires of a twisted pair of a data bus. The coupler assembly noninvasively couples the data bus to the conductor wires by using mating pairs of E-shaped electromagnets having windings about central legs of the electromagnets which are electrically connected to a control unit to sense and transmit signals along the data bus. A base having a cavity to receive conductor wires positioned adjacent to the lower electromagnets is mounted to a panel. A housing with upper electromagnets includes a circuit substrate having trace windings about substrate apertures, an electronic subassembly to which the windings are electrically connected to amplify transmitted and received signals, and a shielded electrical connector secured at a connector end connected to circuits of the electronic subassembly and matable with a connector of a cable extending to the control unit. The housing is releasably connected to the housing via a fastening means and securing means.

U.S. Pat. No. 4,264,827 discloses a method of sensing the transmission of low-level signal current through an electrical conductor without an electrical connection to the conductor, using a continuous closed loop conductor wire extending from a current source with coils of the conductor looped around magnetic coil articles connected to electronic devices, which arrangement senses changes in the electromagnetic field established by the current. The arrangement can be repeated at a plurality of locations spaced along the conductor without detrimental effect to the signal transmission, and can allow signaling of a plurality of electronic devices in response to the signal current passing through the conductor.

Such a current sensing system is desired to be placed aboard aircraft for use with black boxes and other electronic control units, as is disclosed in ARINC Standard 629 recently issued by the Airlines Electronic Engineering Committee (AEEC) of Aeronautical Radio, Inc. (ARINC) of Annapolis, Md., and AEEC Letters Nos. 87-094/SAI-309, 87-122/SAI-313, and 88-077/SAI-331, which are incorporated herein by reference. Such a system may also be used in other environments where it is desired that a single closed loop data bus be used.

The couplers above provide important advantages in operation and assembly. Nevertheless, none of these data current mode couplers uses single-motion panel-mounting means, a wire retainer disposed to secure the conductors of the twisted pair in the elastomeric wire nest for wire positioning within the wire channels, and a housing having improved heat transfer characteristics and electromagnet shielding using a finned housing. It is desired to devise an improved noninvasive coupler for sensing and transmitting electrical signals from a twisted pair of a data bus, which provides these important advantages.

SUMMARY OF THE INVENTION

It is an objective of the present invention to provide a housing for an improved current mode coupler which is complementary to a coupler base which is easily assembled on a panel, connected to a data bus system, disassembled therefrom, and removed from the panel.

It is another objective to provide a coupler housing having improved electromagnetic shielding which protects the components of a coupler from EMI/RFI, and having improved heat transfer characteristics using heat transfer fins.

It is a further objective of the present invention to provide a housing for a coupler system which embodies superior characteristics in terms of temperature stability, heat dissipation, and shielding of electrical interference caused by high intensity radio frequencies and lightning.

It is a further objective of the present invention to provide a housing for a coupler system which is optimally positioned with its major axes oriented along the vertical or horizontal.

A housing for a coupler comprises an outer shell of thermally conductive material and comprising heat transfer fins defining channels on the outer surface of the housing, the heat transfer fins adapted to receive ambient air flow in a manner that the heat transfer fins direct air flow into the channels between the heat transfer fins; a first cavity in the outer shell disposed to secure an electromagnet or a pair thereof having legs ending in a downwardly facing mating end face; a second cavity in the outer shell adapted to receive and secure therein an electronics package thereinto and fitted with an aperture at a connector face for electrical connection of the electronics package to a control unit.

Preferably, the first cavity contains a pair of E-shaped electromagnets and includes electrical windings around the center leg of each electromagnet which are electrically connected to electrical and/or electronic components of an electronics package secured in the second cavity. The electronics in the second cavity are electrically connected to a control unit. When the housing is connected to a corresponding base which has a corresponding pair of E-shaped electromagnets for completing a pair of electromagnet cores, two channels are formed between the central leg and each outer leg through which signal conductor wires of a twisted pair cable are placed, so that the conductor wires are inductively coupled to the control unit via the electronics. Also preferably the outer shell of the housing is made out of thermally and electrically conductive metal, and includes a support member along a base-proximate face and an outer shell member assembled thereto. The outer shell member has an array of heat transfer fins placed at a 30° to 60° angle to the major axes of the housing. The heat transfer fins are oriented diagonally to the housing axes to advantageously utilize ambient air flow for heat dissipation when the coupler is mounted to a panel with its axes conventionally parallel to or orthogonal to the longitudinal axis of an aircraft for example, along which the twisted pair cable would be routed, which generally is parallel to ambient air currents.

The invention itself, together with further objects and attendant advantages, will best be understood by reference to the following detailed description taken in conjunction with the accompanying drawings.

DETAILED DESCRIPTION OF THE INVENTION

Figure 1:
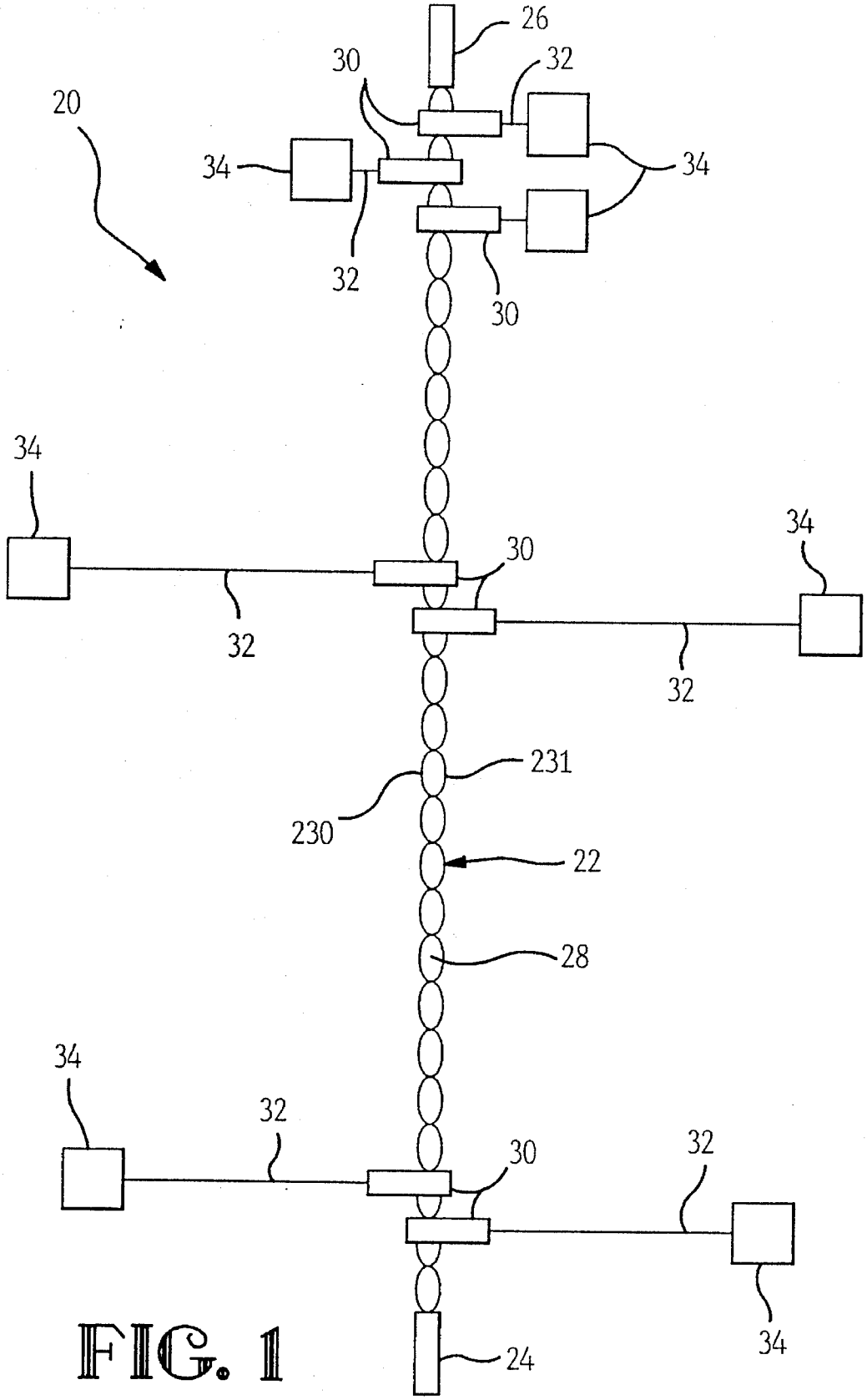
FIG. 1 is a diagrammatic view of a data bus system.

Turning now to the drawings, FIG. 1 shows a representation of the data bus system 20 to which the present invention is relevant. A twisted pair cable 22 of conductor wires 230,231 extends between end terminations 24,26 and comprises a closed loop, and a plurality of loops 28 occur at selected spacing, each loop having a length and shape selected to minimize impedance effects and signal reflection. At selected loops 28 are mounted current mode coupler assemblies 30 each having a width preferably less than a loop length to avoid distorting the desired loop length and shape, thereby avoiding impedance effects and signal reflection. Stub cables 32 extend from respective coupler assemblies 30 to respective control units 34 such as black boxes, providing electrical connections therebetween. Each control unit 34 preferably has a Serial Interface Module (not shown) for modifying digital signals from Manchester Encoded Signals to be transmitted along the data bus system, and correspondingly for translating such encoded signals into digital signals for integrated circuits within the control unit. Each control unit 34 will also provide power for the amplifiers in a respective coupler assemblies 30 to boost received and transmitted signals.

Figure 2:
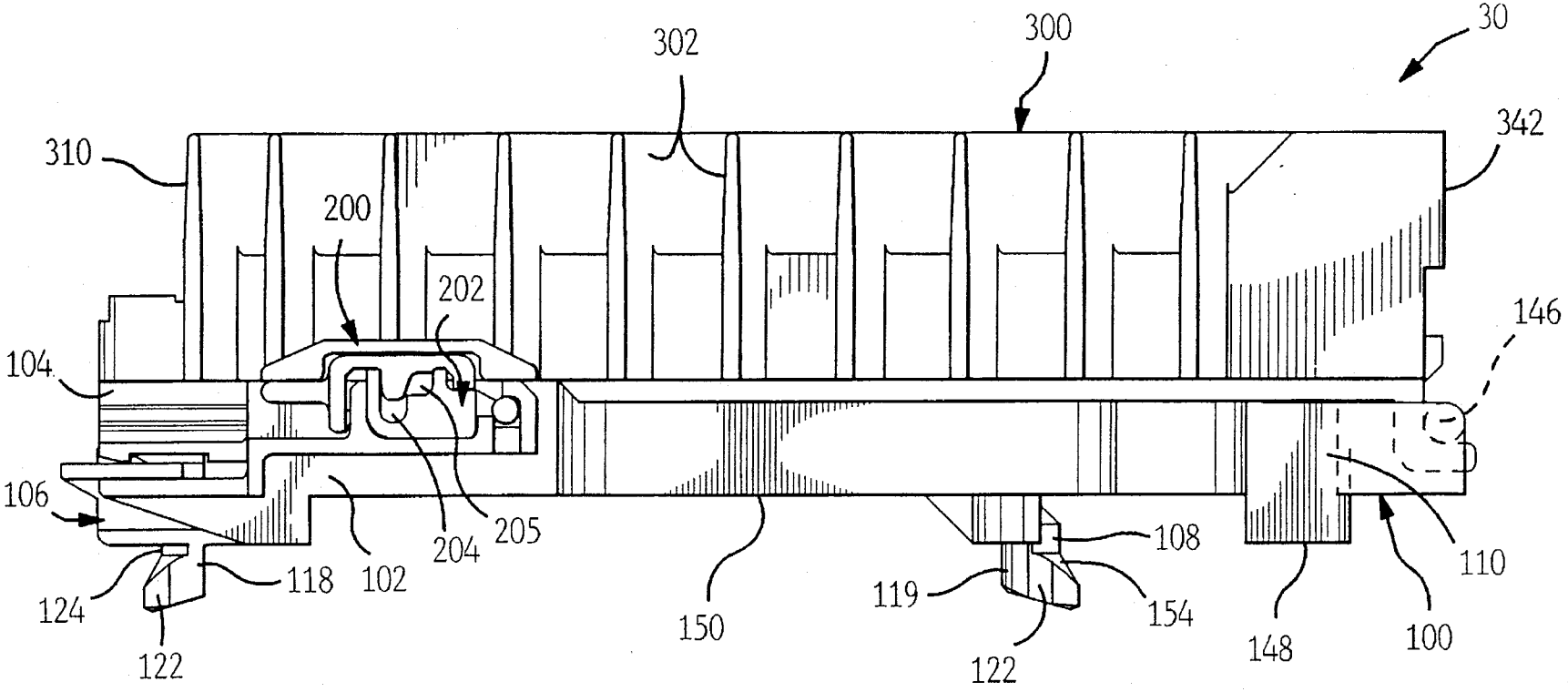
FIG. 2 is an elevation view of a current mode coupler assembly of the present invention mounted to a panel.
Figure 25:
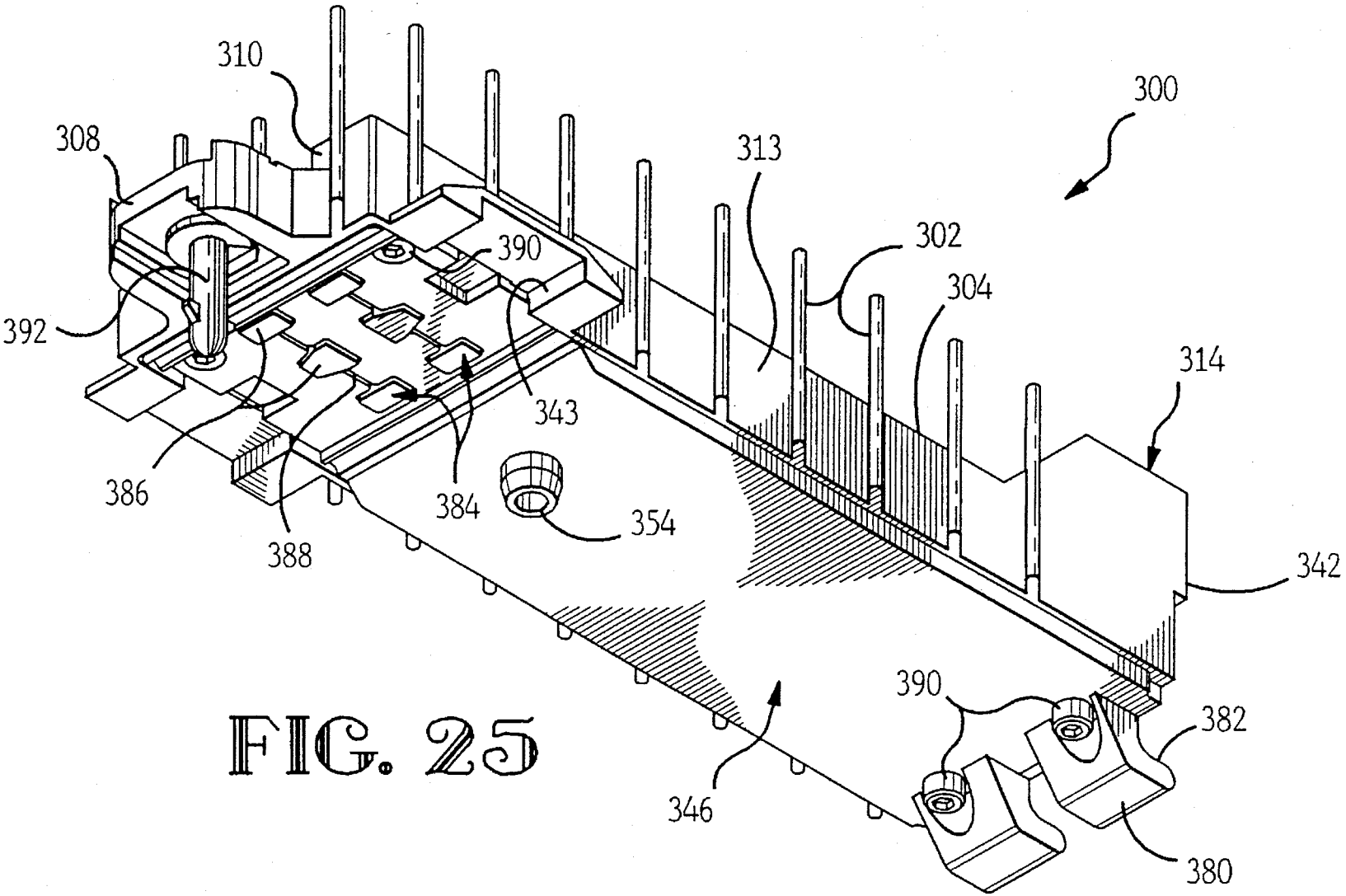
FIG. 25 is a bottom isometric view of the coupler housing assembly from forwardly thereof.

The coupler assembly 30 of the present invention is coupled to the twisted pair 22 of conductor wires 230,231 of a data bus system 20 such as that of FIG. 1 and as disclosed in U.S. Pat. Nos. 4,904,879 and 4,264,827, and the AEEC Letters referred to herein. The coupler assembly 30 is non-invasively affixed at a selected location therealong at a loop 28 of the twisted pair. Each coupler assembly 30 comprises a coupler base disposed to include an elastomeric wire nest member having legs of "E" shaped electromagnets extending to the top surface thereof, and having channels coursing therealong to receive respective conductor wires of a twisted pair cable around the center electromagnet legs. A housing assembly 300 is disposed to be removably secured to the base, as shown in FIGS. 2 and 25. Housing 300 contains an E-shaped electromagnet associated with each electromagnet of the coupler base; an electronics package containing electronic components within an enclosed shielded cavity, the electronics package includes circuitry having windings around center legs of each E-shaped electromagnet within housing 300; and an electrical connection port enabling connection to a control unit. The base is mounted to a panel at a location along the data bus 20 of FIG. 1 by a single-motion panel-mounting system, at which position the housing receives ambient air flow to cool the electronics in the housing.

Figure 3:
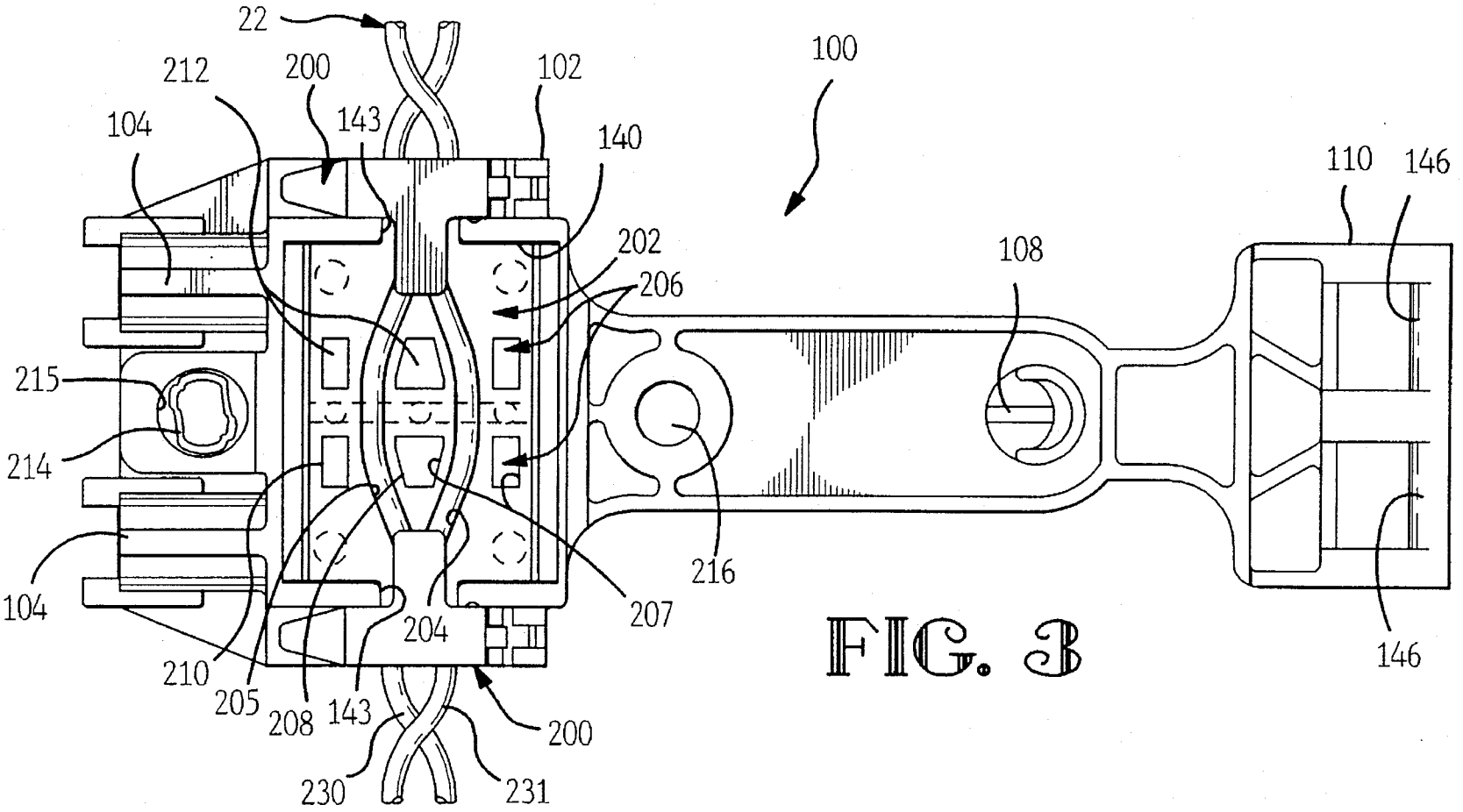
FIG. 3 is a plan view of the coupler base in which is disposed a wire nest with electromagnets therein with the conductors of the twisted pair cable disposed in channels coursing around the central electromagnet legs.

Referring to FIGS. 2 and 3, the coupler base 100 comprises a twisted pair end 102 generally containing a wire nest 202 having wire channels 204,205 along which will be disposed conductors of the twisted pair cable 22 of the data bus 20, retained therein by wire retainers 200 at each cable exit; twisted pair end 102 also includes an aperture 215 within which is disposed securing means 214 for securing coupler housing 300 to coupler base 100. Twisted pair end 102 includes projections 104, movable mounting means or a pair of mounting body members 106 extending from the coupler base 100, a fixed engaging member 108 located between the twisted pair end 102 and a pivot end 110 opposite the twisted pair end 102. A system for enabling single-motion panel mounting of the coupler base to a panel is disclosed in U.S. patent application Ser. No. 07/226,220 filed Nov. 1, 1994 (concurrently herewith) and assigned to the assignee hereof. A wire retainer 200 is disclosed in U.S. patent application Ser. No. 07/996,759.

Pivot end 110 of the coupler base 100 includes a pivot means 146 cooperable with projections 380 so that pivot end 342 rotates about pivot end 110 of coupler base 100 for securing to pivot end 342 of coupler housing 300. Lower surface 150 of coupler base 100 defines support surfaces 148 for abutting the adjacent panel surface and providing support when the coupler base 100 is mounted to a panel. Lower surface, 150 also includes a fixed engaging member 108 comprising an engaging section 119 extending in a downward direction for securing the coupler base 100 to a panel. An aligning recess 216 is shown which receives an aligning post from coupler housing 300 during coupler assembly, with securing aperture 215 including a securing means 214 which locks the housing to the base by a cooperating securing means thereof, which may be for example, as shown in FIG. 25, a quarter-turn fastener of the type sold by Southco, Inc. of Lester, Pa. under Part Nos. 82-11-240-16, 82-32-101-20, and 82-99-205-15.

Wire nest 202 includes an elastomeric body secured in a cavity 140 of coupler base 100 such as by adhesive material, and secures a pair of electromagnets 206 therein. Each electromagnet 206 comprises a center leg 208 and two outside legs 210, which legs 208,210 extend upwardly from a crossing section and through leg-receiving holes 207 through the elastomeric retainer 202 and terminate in mating faces 212. Coupler housing 300 also includes a pair of E-shaped electromagnets each with a center leg and two outside legs terminating in mating faces which, upon assembly, mate with the mating faces 212 of corresponding electromagnets 206 in the electromagnet receiving cavity 140. Channels 204,205 course between center legs 208 and outer legs 210 of both electromagnets 206.

Turning now to FIGS. 4 to 17, an outer shell member 314 for outer shell member 314 assembly according to the present invention is shown. Coupler 300 is shown with heat transfer fins 302 extending outwardly from the outer surfaces thereof in a plane perpendicular to the upper surface 304 of outer shell 314 and at an angle to the major axes thereof. Heat transfer fin channels 306 are formed by the heat transfer fins 302. Flange 308 extends from the front end 310 of outer shell member 314 and includes therein an aperture 312 which is adapted to receive therethrough securing means such as a quarter-turn fastener 392 of FIG. 25 for securing the coupler housing 300 to a coupler base 100 at twisted pair end 102.

Figure 5:
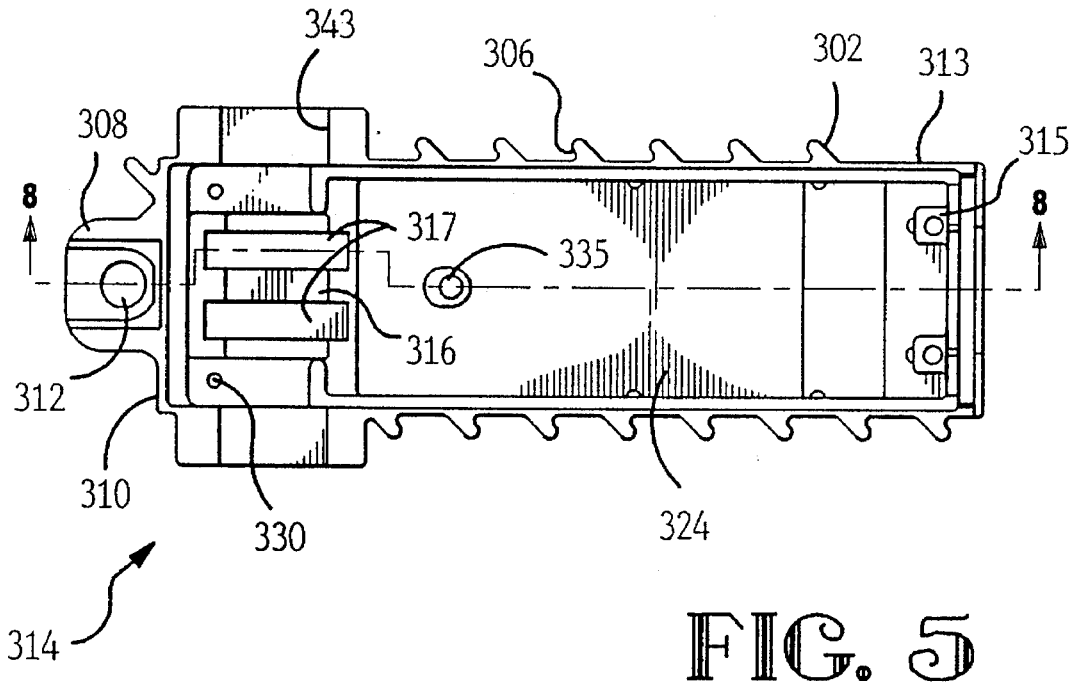

Referring to FIG. 5, heat transfer fins 302 extend from the side walls 313 of the outer shell 314. A first cavity 316 comprises cavities for a pair of E-shaped electromagnets 317. Slots 343 are shown which provide clearance for upper portions of wire retainers 200 which hold the wires of a twisted pair cable within the wire nest until full assembly of the coupler housing to the coupler base (see FIGS. 2 and 3). Also seen is a second cavity 324, apertured mounting posts 315 adjacent pivot end 342, and an aligning post 335 which extends below the lower edges of outer shell 314.

Figure 6:
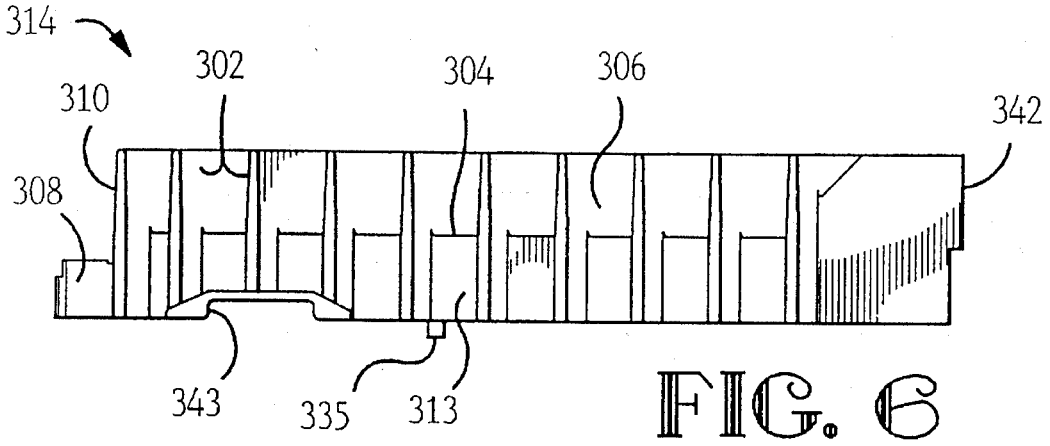

Turning to FIG. 6, a side plan view of a outer shell member 314 according to the present invention is shown with the heat transfer fins 302 formed above the upper surface 331 of the outer shell 314.

Figure 7:
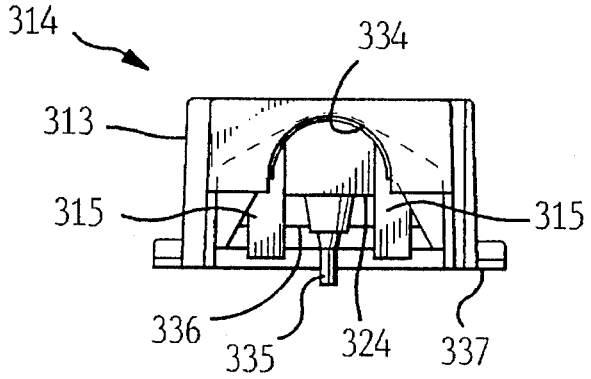
Figure 8:
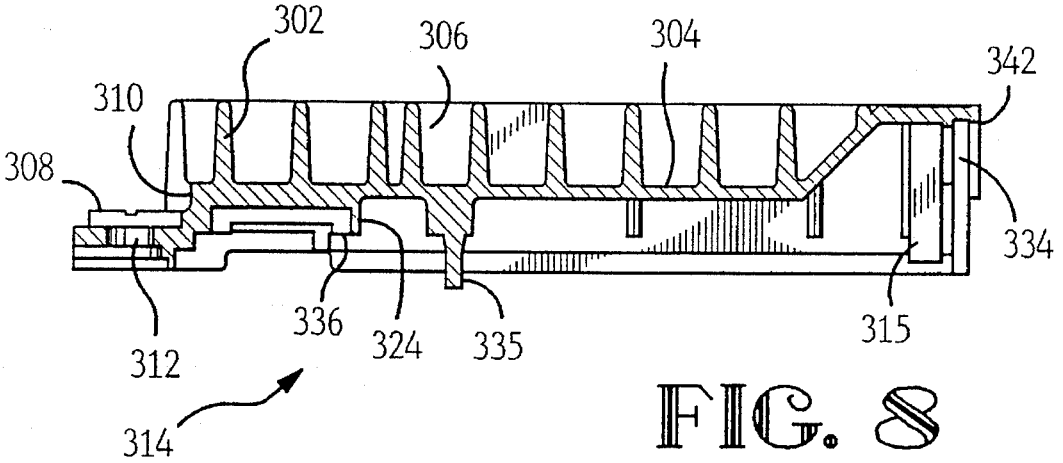
FIG. 8 is a cross-sectional view of the outer shell member outer shell member along line 8—8 of the outer shell member of FIG. 4.

As shown in FIGS. 7 and 8, aligning post 335 extends below the plane of the lower edge 337 of the outer shell 314. An aperture 334 is shown, the aperture 334 partially defining an opening for providing an electrical connection between electronics (not shown) in the second cavity 324 and a control unit 34 (FIG. 1). At the end of the second cavity 324 is a wall 336 separating first cavity 316 and second cavity 324.

Figure 4:
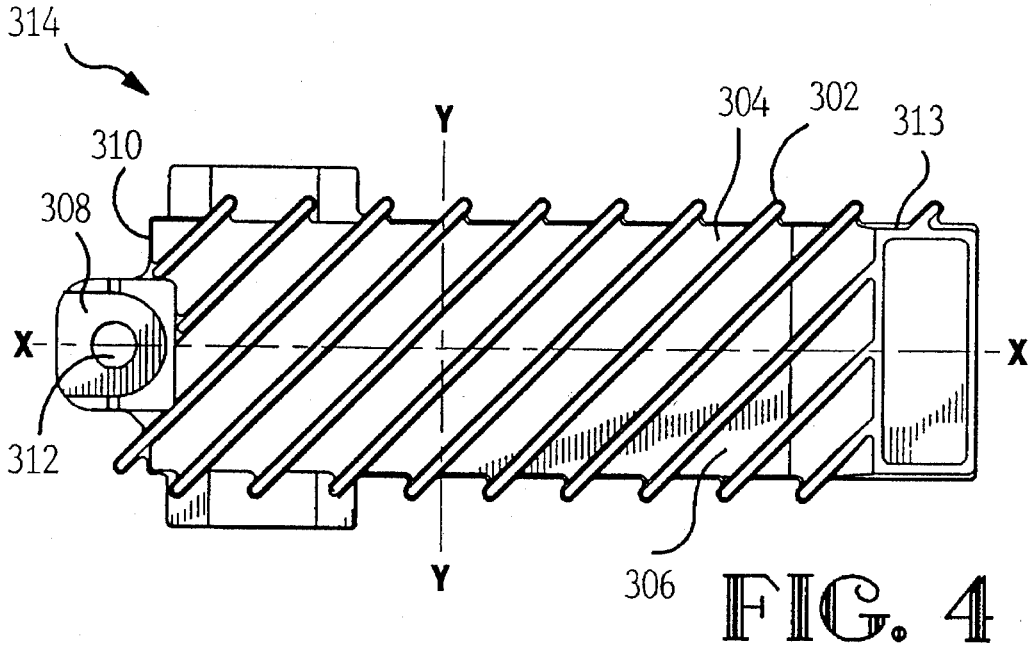
FIGS. 4 to 7 are top, bottom, side and end views of a an outer shell member of coupler housing according to the present invention.
Figure 9:
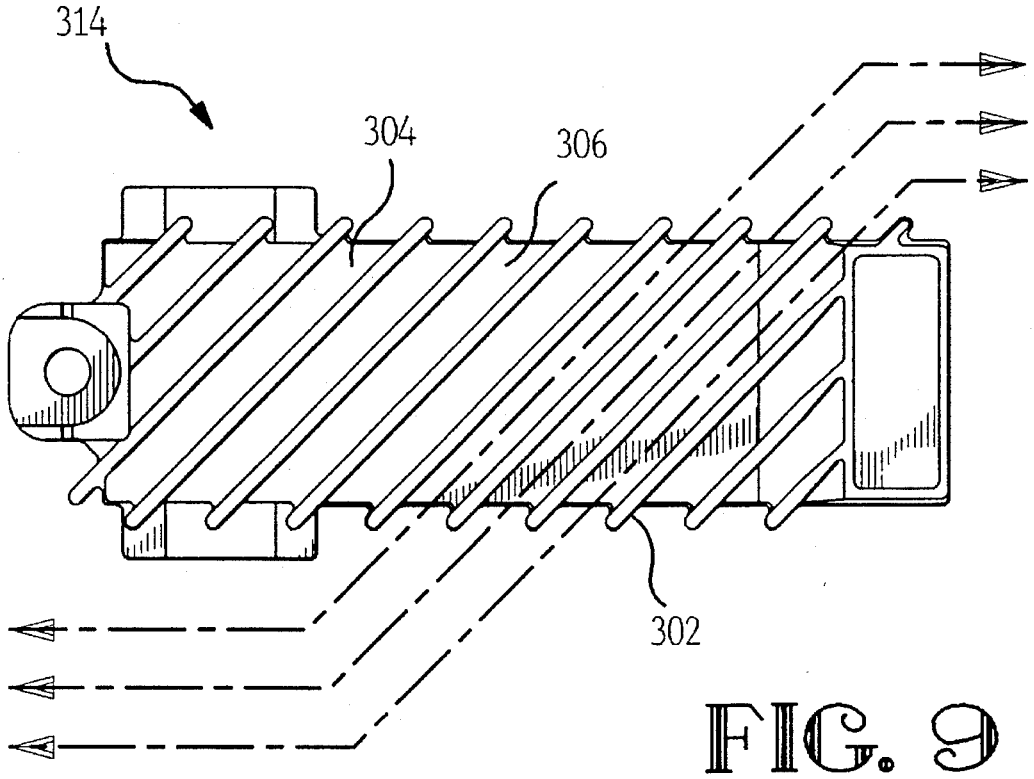
FIG. 9 is a top air flow pattern around the outer shell member outer shell member of FIG. 4 shown in FIG. 4 mounted vertically along its major axes where the air flow is in the horizontal direction.

Turning to FIG. 9, a top air flow pattern is shown around the outer shell member shown in FIG. 4 mounted vertically along its major axes where the air flow is in the horizontal direction. In FIG. 9, the top view of the outer shell member 314 in FIG. 4 is shown with arrows signifying the air flow. When the air flow in the environment of the coupler housing 300 is in the direction of the major axes the coupler housing 300 in FIG. 4, the air flow is deflected into channels 306 by the heat transfer fins 302. In this way, optimal cooling of the coupler housing 300 is afforded by directing the air flow through the heat transfer fin channels 306 thereby transferring heat from the coupler housing 300 and the outer shell 314.

Figure 10:
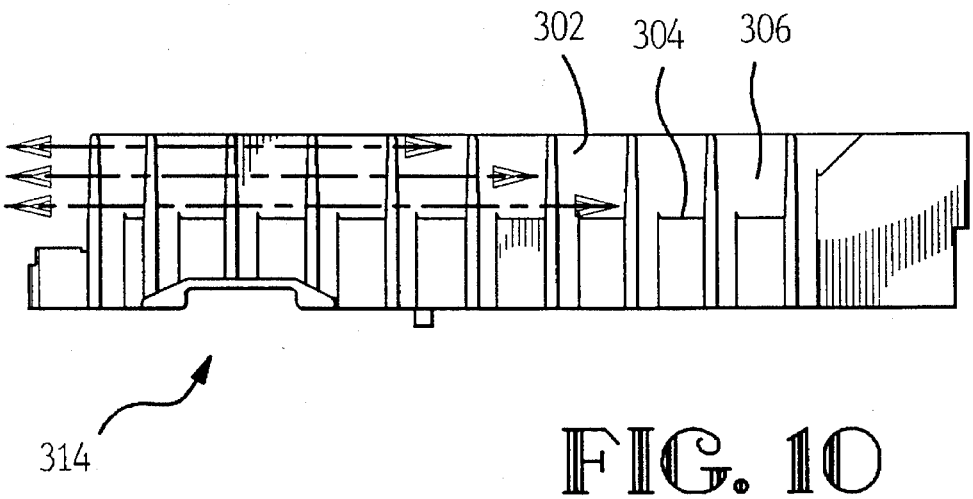
FIG. 10 is a side air flow pattern around the outer shell member outer shell member of FIG. 4 shown in FIG. 9.

Turning to FIG. 10, a side view of the outer shell member 314 in FIG. 9 is shown, with the air flow as illustrated from the side. In FIG. 10, the air flow of the environment of the outer shell member 314 is in the direction parallel to the major axes thereof. Air flow enters the heat transfer fin channels 306 from the side opposite the view of FIG. 10, and emerges from the heat transfer fin channels 306 in the direction out of the drawing. At that point, the air flow meets with the air flow of the environment and becomes integrated into the air flow again traveling parallel to the major axes of the coupler housing 300.

Figure 11:
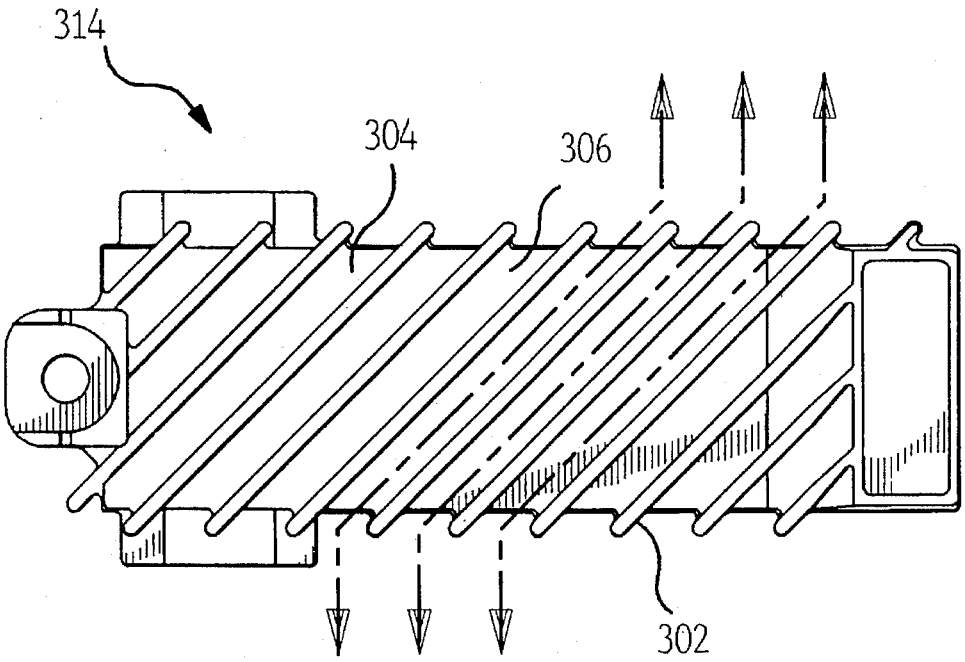
FIG. 11 is a top air flow pattern around the outer shell member outer shell member of FIG. 4 shown in FIG. 4 mounted horizontally on a wall where the air flow is horizontal.

Turning to FIG. 11, top air flow pattern around a coupler housing 300 shown in FIG. 4 is shown mounted horizontally on a wall where the air flow is vertical. In FIG. 11, the air flow of the environment is in a direction perpendicular to the major axes of the outer shell member 314. When the air flow makes contact with the heat transfer fins 302, it is deflected into the heat transfer fin channels 306, which are situated at an angle of 45° from the major axes. In this way, optimal cooling is afforded by directing the air flow through the heat transfer fin channels 306 thereby transferring heat from the outer shell 314 to the environment and cooling the housing 300.

Figure 12:
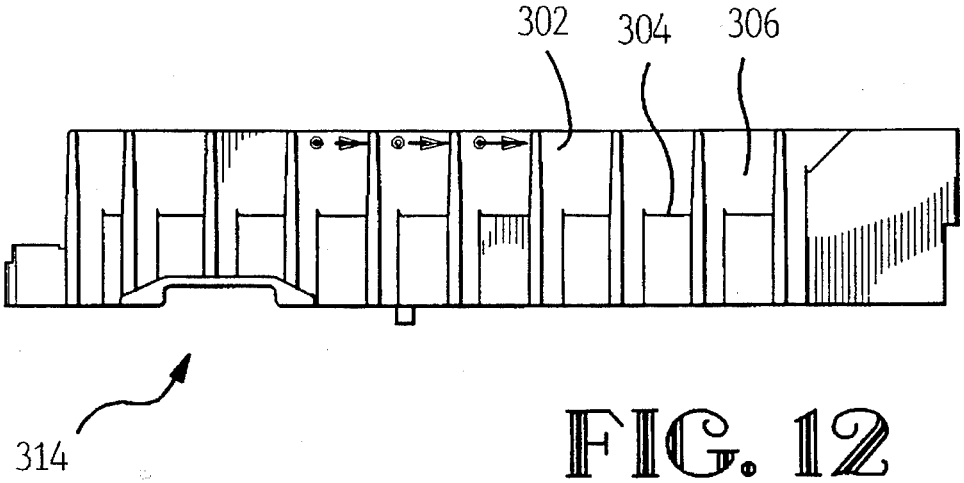
FIG. 12 is a side air flow pattern around the outer shell member outer shell member of FIG. 4 shown in FIG. 11.

Turning to FIG. 12, a side air flow pattern around the outer shell member 314 shown in FIG. 11 is shown. In FIG. 12, the air flow is entering in the direction into the paper, contacting the heat transfer fins 302 and being deflected through the heat transfer fin channels 306.

Figure 13:
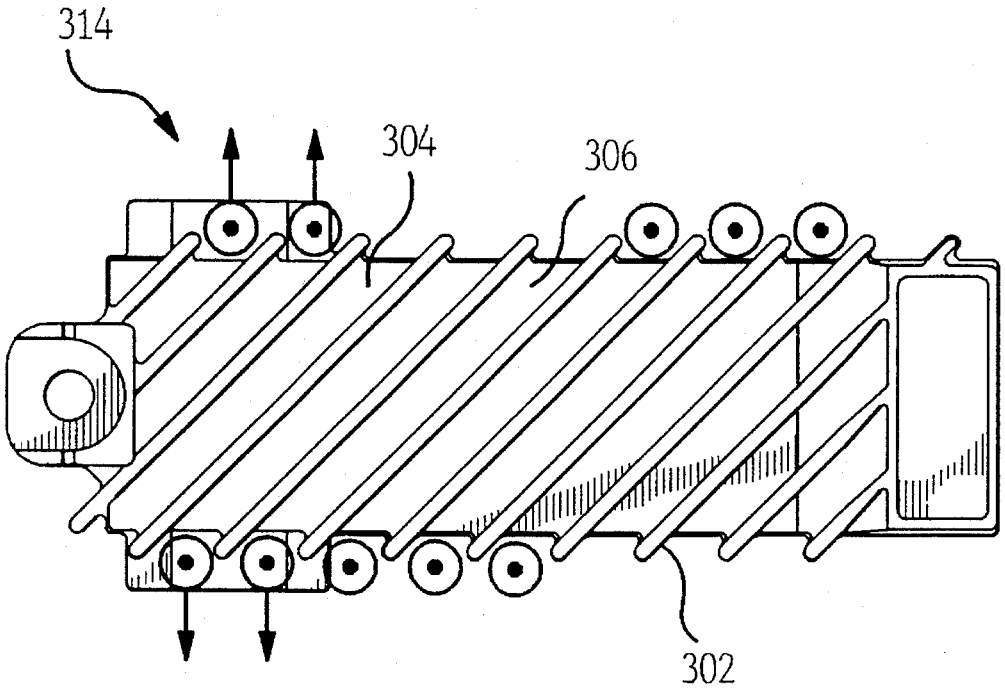
FIG. 13 is a top air flow pattern around the outer shell member outer shell member of FIG. 4 shown in FIG. 4 flat mounted on a panel where the air flow is perpendicular to the plane of the paper.

Turning to FIG. 13, an air flow pattern around the outer shell member 314 shown in FIG. 4 flat mounted on a panel where the air flow is vertical from the panel is shown. As can be seen in FIG. 13, the air flow contacts the outer shell member 314 in the upward direction passing through the heat transfer fin channels 306 formed by the side edges 338 of the heat transfer fins 302 which extend beyond the outer shell 314 in the outward direction. The air flow depicted by encircled dots flows directly through the heat transfer fin channels 306 and in the direction into the paper of the drawing.

Figure 14:
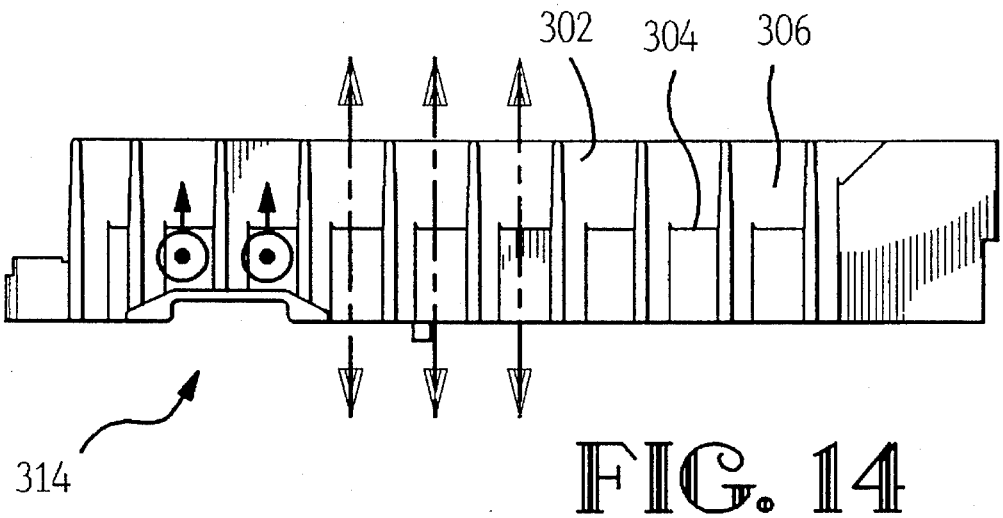
FIG. 14 is a side air flow pattern around the outer shell member shown in FIG. 13.

FIG. 14 shows a side view of the outer shell member 314 housing 300 and air flow depicted in FIG. 13. As can be seen in FIG. 14, the air flow passes through the heat transfer fin channels 306 transferring heat away from the outer shell 314 thereby cooling the coupler housing 300.

Figure 15:
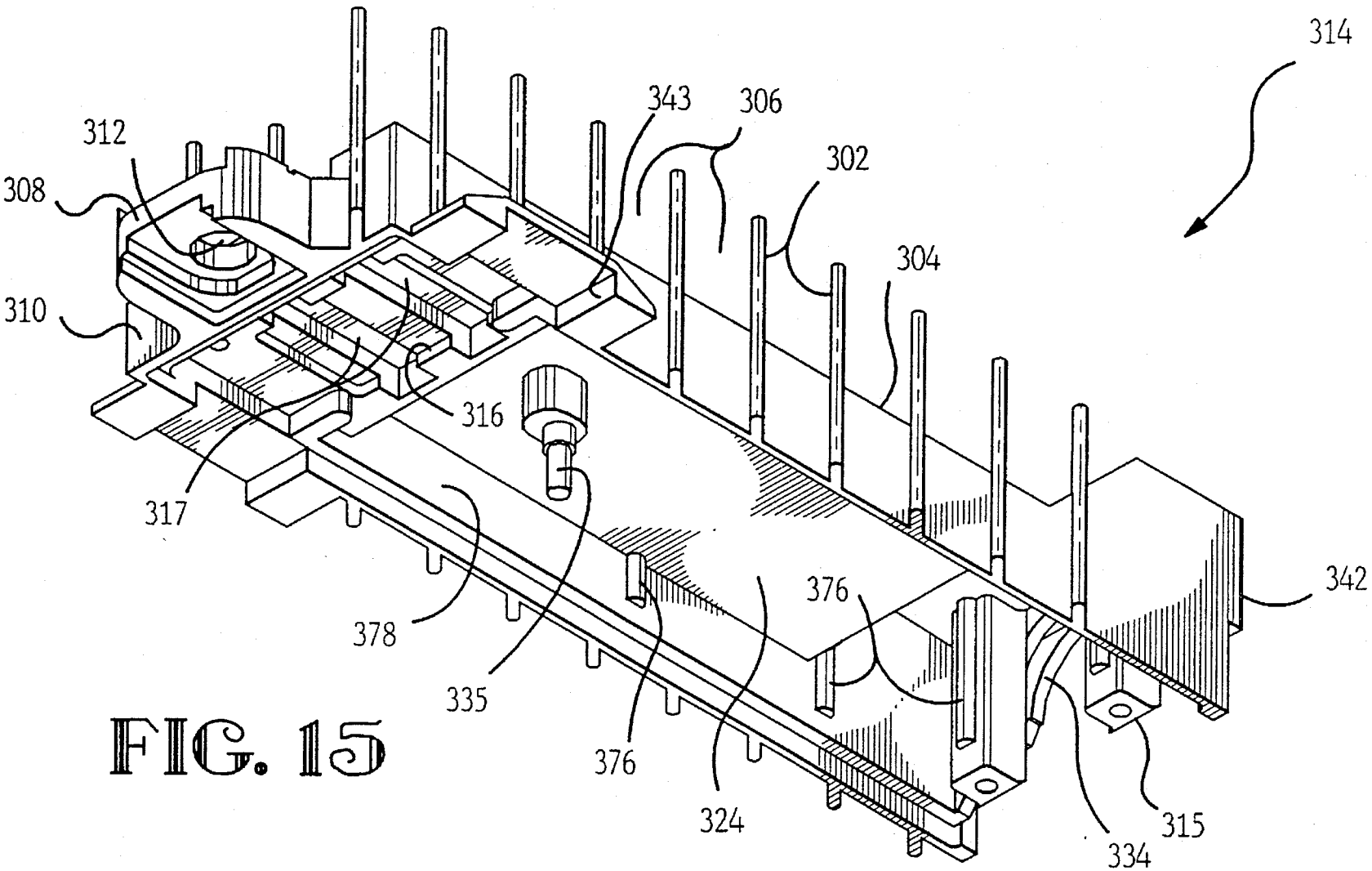
FIG. 15 is a bottom front isometric view of the coupler.

Turning to FIG. 15, a bottom perspective view of outer shell 314 of coupler housing 300 is shown, which can be termed an assembly face to which will be assembled a bottom plate or support member 346 as shown in FIGS. 18 to 21 at an assembly interface to define an outer shell assembly, seen in FIG. 25. A first cavity 316 is shown having portions 317 wherein electromagnets (not shown) and optionally resilient biasing members (not shown) may be placed. A second cavity 324 is shown which can be fitted with an electronics package (not shown). The electronics package is a printed circuit board element upon which are mounted an array of various electrical and electronic components for amplifying the signals received and sent by the coupler along the data bus of FIG. 1. One such electronics package is disclosed in U.S. Pat. No. 4,904,879. In the second cavity 324 is an aligning post 335 which fits into an aligning aperture 354 of bottom plate 346 of FIGS. 18 to 21. A pivot end 342 at the end of the second cavity 324 opposite the first cavity 316 includes mounting posts 315 for enabling securing thereto of bottom plate 346. Also on the pivot end 342 is an aperture 334 for allowing an electrical connection between the electronics package in the second cavity 324 and a control unit. Securing means aperture 312 at the front end 310 of the outer shell member 314 housing 300 opposite the pivot end 342 allows for mounting of a fastener for securing to coupler base 100 (see FIG. 25). Heat transfer fins 302 are depicted extending from the outer shell 314 of the coupler housing 300.

Figure 16:
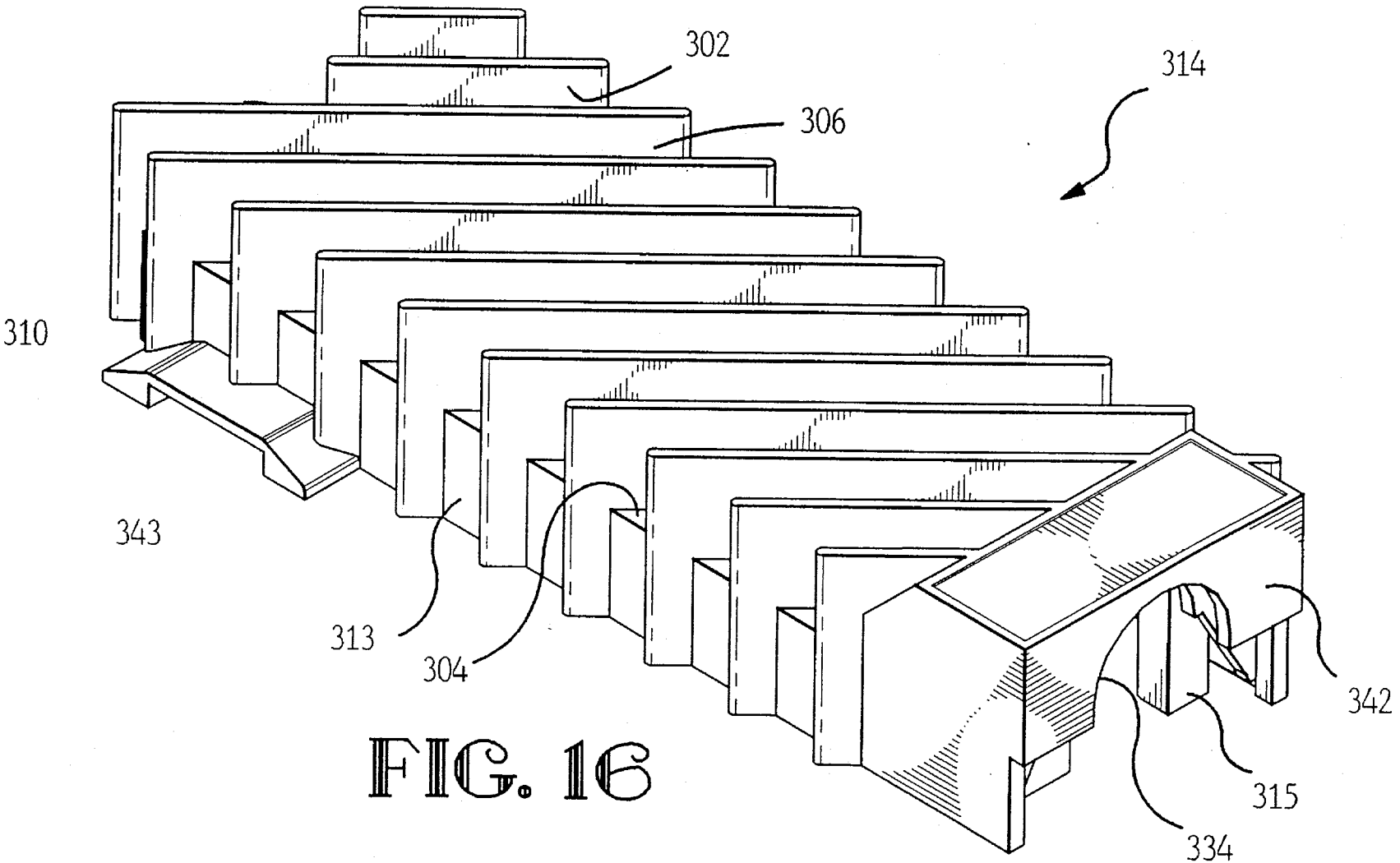
FIGS. 16 and 17 are top rear and bottom rear isometric views of the coupler.
Figure 17:
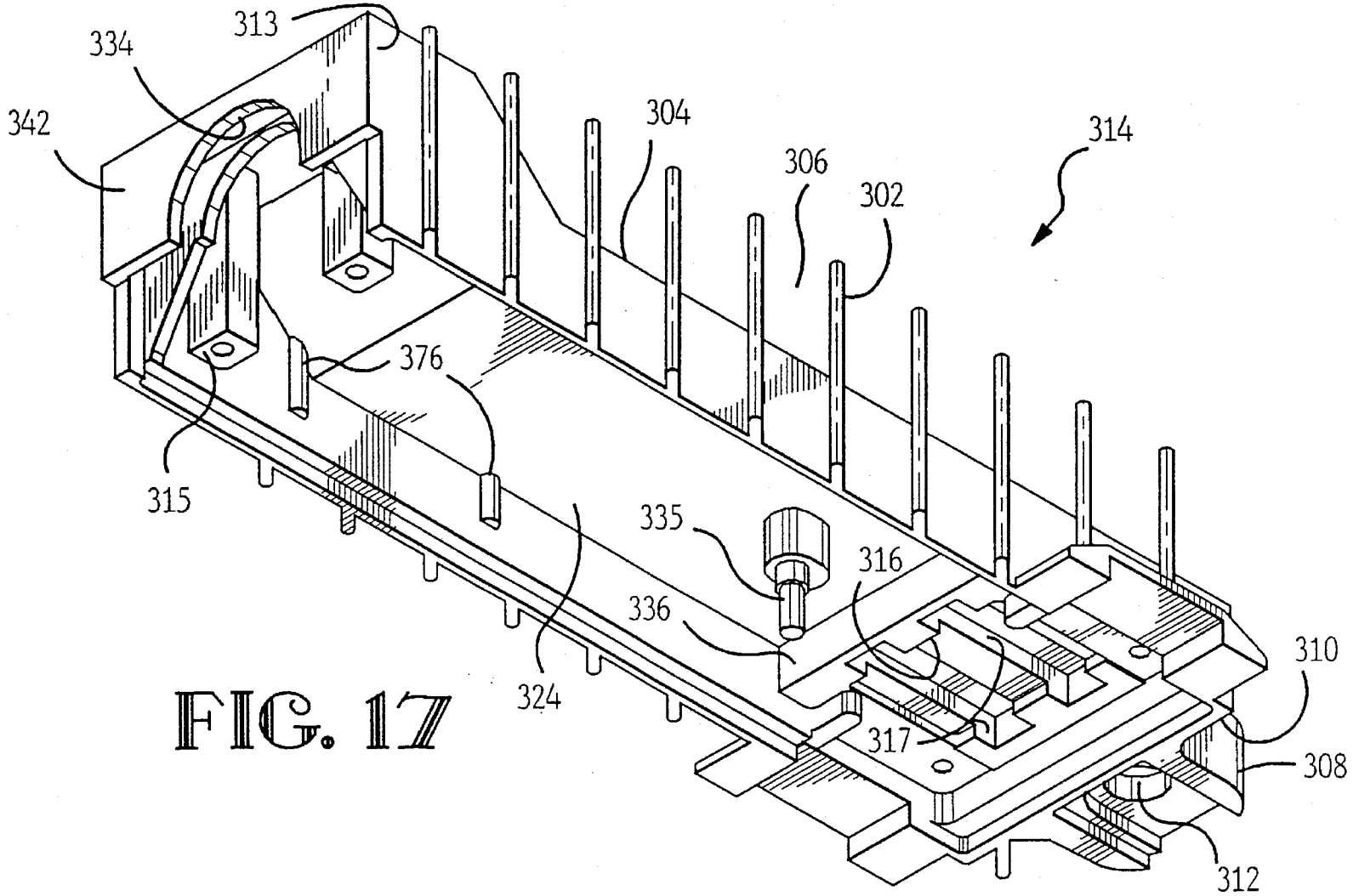
Figure 18:
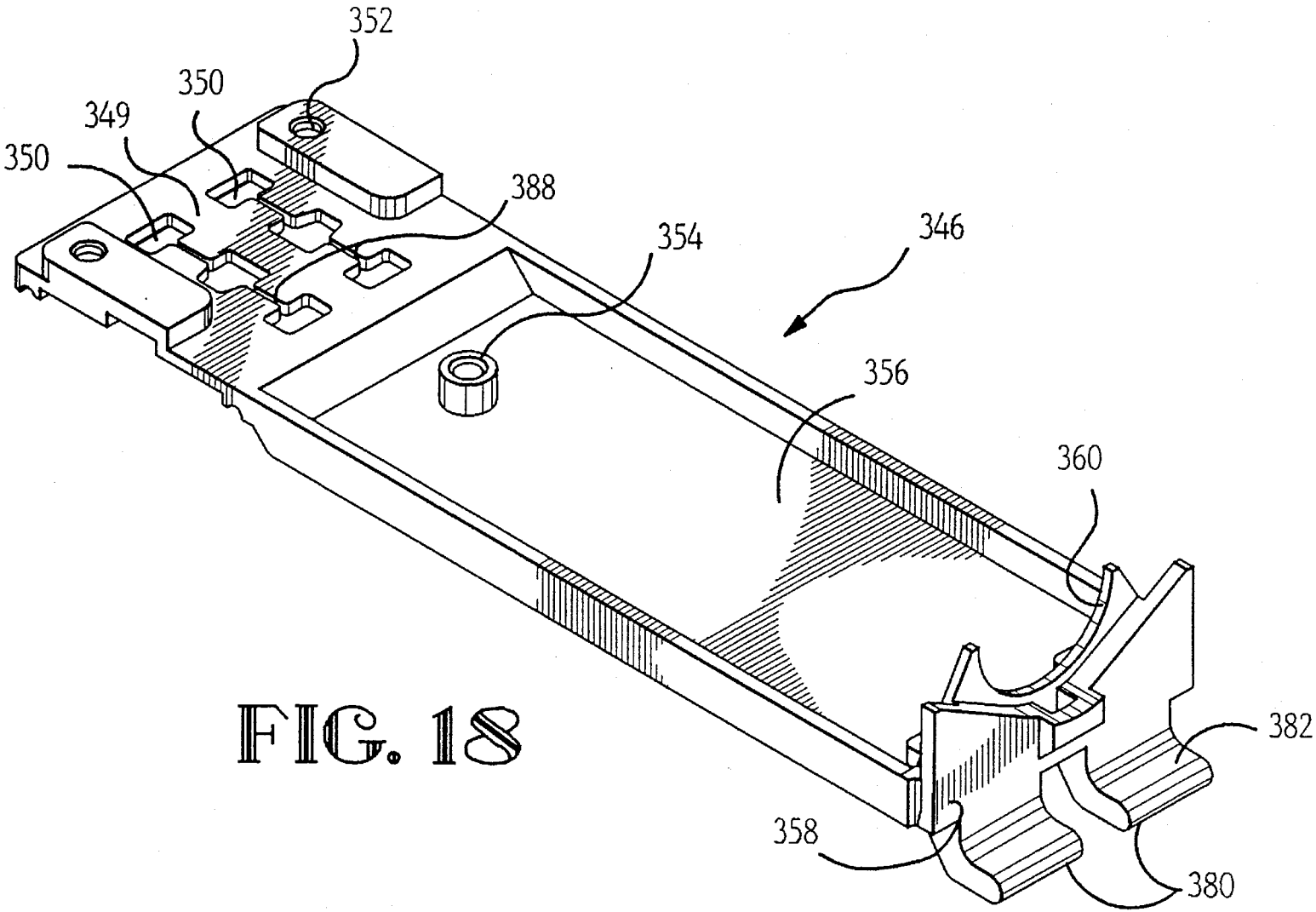
FIG. 18 is a top isometric view of a bottom plate of the coupler.
Figure 19:
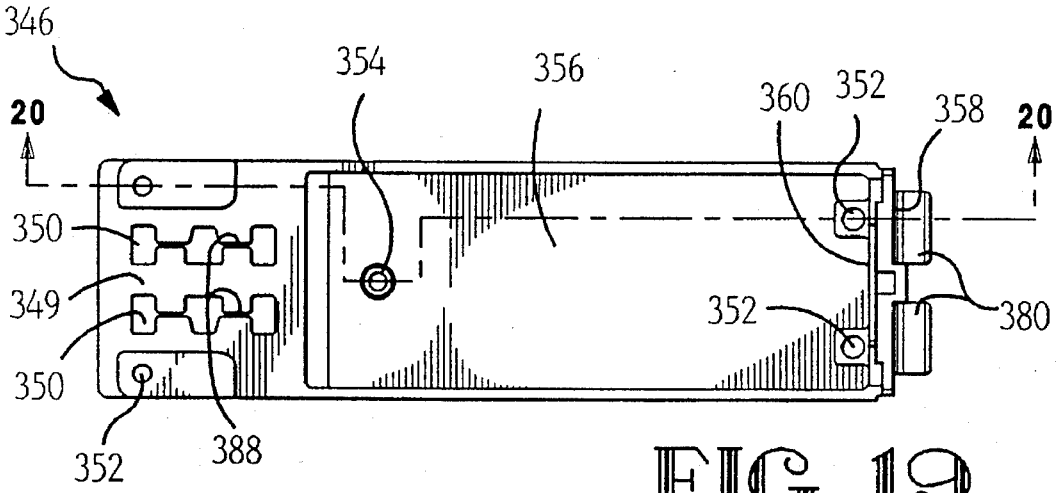
FIGS. 19 to 21 are top, side and end views of the bottom plate of FIG. 18.
Figure 20:
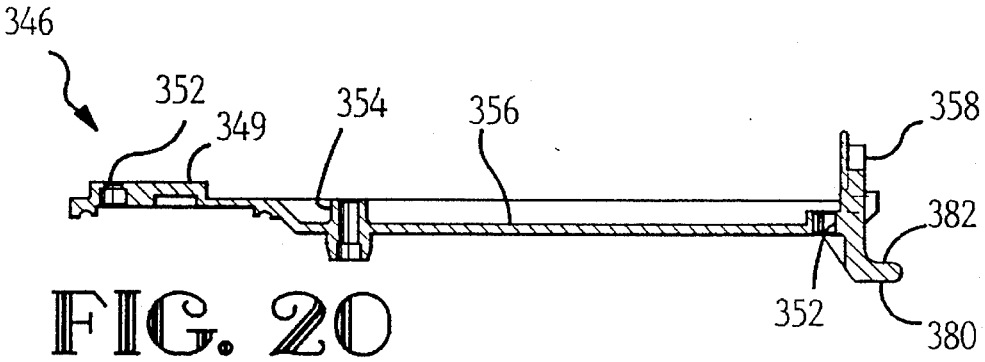
Figure 21:
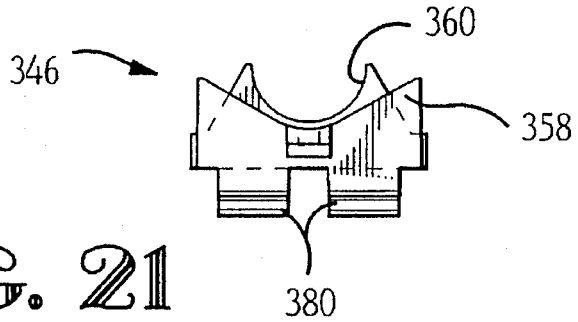

FIGS. 16 and 17 show top and bottom rear isometric views of the outer shell member 314 of FIG. 15, in which the configuration of the heat transfer fins 302 is more clearly illustrated.

Turning to FIGS. 18 to 21, a bottom plate 346 suitable for use with outer shell 314 of FIGS. 4 to 17 of the present invention is shown. Bottom plate 346 comprises a first cavity cover section 349 which includes a pair of electromagnet apertures 350. Each electromagnet aperture 350 allows the center and outer legs of respective E-shaped electromagnets to extend through and slightly beyond the bottom plate 346 for mating faces 386 thereof to be exposed for mating to corresponding mating faces 212 of electromagnets 206 secured in coupler base 100 (seen in FIG. 3). Gaps 388 interconnect all leg-receiving portions of each aperture 350 preventing a conductive path from being formed around any leg of the respective electromagnet thereat during in-service use. Insert securing means or fastener apertures 352 are shown associated with mounting posts 315 of outer shell 314, all of which allow fasteners 390 therethrough and thereinto for securing bottom plate 346 to the coupler housing outer shell. A second cavity cover section 356 is shown with apertured alignment embossment 354 which receives thereinto aligning post 335 of the coupler housing. The bottom plate 346 includes an end plate 358, which connects to the pivot end of the coupler housing, with projections 380 extending outwardly therefrom being insertable first forwardly of and then disposed under and beyond pivot pins 146, with upwardly facing surface 382 bearing thereagainst as the assembled housing 300 (with the electronics package and electromagnets secured therein) is pivoted closed against the upper surface of the coupler base and secured thereto at twisted pair end 102 by a quarter-turn fastener, for example.

The end plate 358 has for an upper surface an arcuate groove 360, which defines part of the aperture for electrical connection means connecting the electronic circuitry of the electronics package in the second cavity at the rear end of the coupler housing to a stub cable 32 extending to a control unit 34 (FIG. 1). When bottom plate 346 is assembled to outer shell 314 with fasteners 390, the arcuate groove 360 on the end plate 358 opposes aperture 334 at pivot end 342 of outer shell 314, together forming a circular opening at a connector face of the housing through which electrical connection is made by a stub cable to a control unit from the electronics package in the second cavity.

Figure 22:
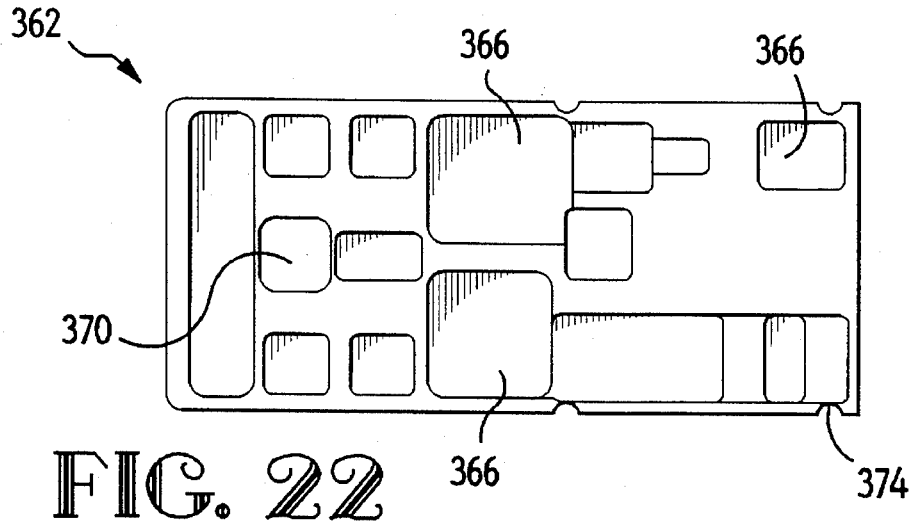
FIGS. 22 to 24 are bottom, bottom isometric and side views of a thermally conductive insert for placement in a cavity of the outer shell member of FIGS. 4 to 21 according to the present invention, to be disposed adjacent an electronics package upon full coupler assembly.
Figure 23:
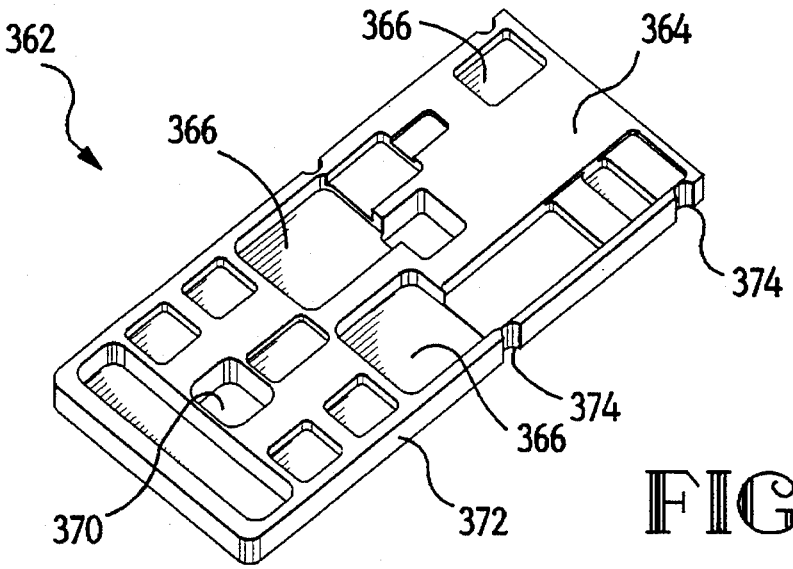
Figure 24:
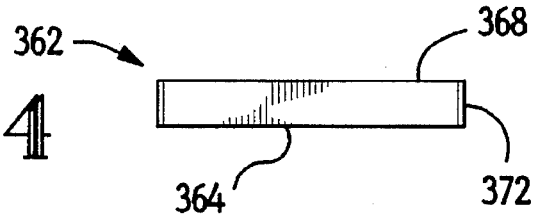

FIGS. 22 to 24 show an insert 362 for placement in coupler housing 300 according to the present invention. Insert 362 is composed of thermally conductive material such as aluminum, and would be affixed within second cavity 324 of housing 300 in thermally conductive engagement with broad surface portions thereof. Insert 362 includes a package-adjacent bottom surface 364 thereon having a topography containing an array of recesses 366 thereinto positioned and dimensioned to receive thereinto portions of electrical and electronic components of the electronics package extending upwardly from a circuit substrate thereof, such as capacitors, resistors, transistors, diodes, and so on, defining amplifier circuits appropriate for signal amplification may be included thereon. The topography of the various features of bottom surface 364 of insert 362 is such as to bring surface portions of the insert preferably to within several thousandths of an inch from opposing surfaces of the various selected components of the electronics package in a preselected array or arrangement, to be as close as possible to facilitate dissipation of heat from the components to the coupler housing 300 for transmission by the fins to the ambient air flow. The insert 362 is suitable for mounting in the second cavity 324 of the coupler housing (see FIG. 15), with planar upper surface 368 abutting a cavity-proximate bottom surface of outer shell member 314 in a thermally conductive manner such as with the use of silver-filled silicone RTV epoxy, and includes a through aperture 370 through which will extend aligning post 335 of outer shell member 314 upon assembly. At selected locations along the peripheral edge 372 are notches 374 which cooperate with embossments 376 along side walls 378 of cavity 324 of outer shell member 314, as seen in FIG. 15, for proper support and positioning of the electronics package and insert 362 into cavity 324.

The insert may be machined from a planar member to match the pattern of components of the electronics package, while permitting the coupler housing outer shell to be cast without regard to the particular topography of the electronics package to be eventually contained in the cavity. Alternatively, the may be cast in a single integral piece with its bottom surface opposing the electronics substrate specifically designed for the components of a known electronics package.

Referring now to FIG. 25, according to a preferred embodiment of the present invention, upon full assembly of the upper portion of the coupler, an electronics package (not shown) would be positioned in the second cavity 324 and bottom plate 346 of FIGS. 18 to 21 fastened along the bottom face of outer shell 314 with fasteners 390. The first cavity retaining cover section 349 retains the electromagnets in the coupler housing, the second cavity retaining cover 356 retains the electronics in the second cavity of the coupler housing, and aligning post 335 of the outer shell extends into apertured alignment embossment 354 in the bottom plate 346. A fastener 392 is seen affixed to and extending from flange 308 of outer shell 314, for receipt into apertures 215 and socket 214 of coupler base 100 of FIGS. 2 and 3 when coupler housing 300 is pivoted to a closed position against coupler base 100; fastener 392 is then rotatable such as with a tool to lock housing 300 to base 100 to define coupler 30 coupled about conductor wires 230,231 of the twisted pair cable.

Preferably the thermally conductive insert 362 of FIGS. 22 to 24 would first be affixed within second cavity 324 prior to insertion of the electronics package, with the topography of the electrical and electronic components along the upper surface of the electronics package being disposed in respective recesses of the insert selected to be complementary therewith, to be preferably only several thousandths of an inch from the surface of the insert for optimum heat dissipation. The electronics package includes conductors defining windings around the center leg of each electromagnet in the coupler housing. The electronics package may comprise a circuit board and circuitry including a signal amplifier. The circuitry of the electronics package is also connected to a control unit 34 through electrical connection means 32 of FIG. 1 extending from the pivot end 342 of the housing 300. In the assembled coupler 30 (see FIGS. 2 and 3), in which the conductors of the twisted pair cable pass through the channels formed by the mated electromagnet pairs in the coupler housing and the coupler base, signals transmitted through the twisted pair of signal conductor cables to the control unit are inductively coupled to the control unit. Similarly, signals sent from the control unit are inductively coupled to the twisted pair cable conductor wires. Signals sent in either direction, either from the control unit, or through the twisted pair cable, are amplified by the signal amplifier in the electronics of the housing.

Variations of the embodiments described above are possible. The coupler base is preferably formed from molded dielectric plastic material, such as nylon, or a liquid crystal polymer ("LCP"). Similar to the base, the mounting body members are preferably formed from molded dielectric plastic material, such as nylon, or a liquid crystal polymer.

With respect to the coupler housing, the heat transfer fins may be positioned in any configuration which forces air flow through the heat transfer fin channels. Thus the heat transfer fins according to the present invention may be straight, curved or multidirectional. It is preferred to place the heat transfer fins at an angle of between 30° and 60° from the major axes of the housing. Where the coupler, and thus the housing, is mounted so that its major axes is horizontal or vertical, the use of fins as described in the present invention will force the air flow through the heat transfer fin channels, thus cooling the coupler. It is also preferred to have the heat transfer fins extend around the entirety of the outer surface of the outer shell. Positioning the heat transfer fins to the perpendicular to the major axes of the housing, where the coupler, and thus the housing is mounted on a wall in the vertical or horizontal direction, will allow minimal air flow through the channels. Thus, this configuration should be avoided.

The outer shell can be made of any material which is effective in transferring heat away from the housing. Metal is preferred, and aluminum is particularly preferred. Shielding is optimally applied to the inner surface of the first and second cavities of the housing, thus providing for protection from EMI/RFI interference with the circuitry in the housing when the housing is of a thermally conductive material other than metal, and generally plating is the preferred mode of providing such shielding. Also, variations are envisioned wherein the outer shell comprises two or more members, one of which forms the outside of the shell and includes the heat transfer fins and another of which closely conforms to the electronics in the second cavity. In this embodiment, the closely conforming member can be in the form of a modular insert, and thus, different modular inserts can be used for different electronics configurations.

According to the present invention, a second electromagnet corresponding to a second electromagnet in a coupler base may be positioned in the first cavity. In this way two pairs of closed electromagnet coils are formed on the twisted pair of signal conductor cables, the first pair being formed by the first electromagnet when mated with the corresponding first electromagnet in the base, and the second pair being formed by the second electromagnet when mated with the corresponding second electromagnet in the base. The electromagnet coils formed by the first electromagnets can thus be used for inductively coupling signals transmitted along the twisted pair of signal conductor cables to a control unit, and the electromagnet coils formed by the second electromagnet can be used for inductively coupling signals transmitted from the control unit to the twisted pair of signal conductor cables, or vice-versa.

As is understood from the specification, the housing may be mounted on a vertical wall, a ceiling or floor, or in any position so that the air flow is received into the heat transfer fin channels. Moreover, a coupler with a housing according to the present invention may be mounted in any manner in addition to the parallel, horizontal or flat mount methods described herein which are commonly utilized in the art, for example, by flush mounting.

In order to take advantage of the heat transference characteristics of the housing according to the present invention, it is preferred to have the outer shell closely conform to the electronics in the second cavity. In this way, heat generated from the electronics will be transferred efficiently to the outer shell and away from the housing. One especially preferred embodiment has low power electronics units being in close conformity with the lower surface of the housing and high power electronics units being in close conformity with the upper surface of the outer shell. In this embodiment, electronics which have greater heat generating capacity are placed closer to the outer shell, and thus the heat generated by them is more efficiently transferred away from the housing.

Of course, it should be understood that a wide range of changes and modifications can be made to the preferred embodiment described above. It is therefore intended that the foregoing detailed description be understood that it is the following claims, including all equivalents, which are intended to define the scope of this invention.

What is claimed is:

1. A housing for an electronics package having an array of electrical and electronic components mounted on a circuit board, comprising:

a support member and an outer shell member adapted to be secured together at an assembly interface to define therebetween a cavity for enclosing and housing therewithin the electronics package, at least said outer shell member being formed of thermally conductive material;

said outer shell including an assembly face at said assembly interface and an opposed outer surface and adjacent side surfaces, and further including a connector face for electrically connecting said electronics package to another article after complete assembly; and said assembly face of said outer shell including a package-adjacent surface including a plurality of component-receiving recesses thereinto, said package-adjacent surface thereby being shaped and contoured to complement the shape and contour of the components of said electronics package closely adjacent therewith, whereby said outer shell is especially adapted to receive heat from said electronics package during in-service use thereof, for dissipation of thermal energy thereby enhancing long-term in-service use.

2. The housing as set forth in claim 1 wherein said package-adjacent surface is provided by an insert of thermally conductive material secured along said assembly face of said outer shell in intimate thermally conductive relationship therewith.

3. The housing as set forth in claim 1 wherein said support member is secured along said assembly face of said outer shell peripherally around said electronics package disposed in said cavity.

4. The housing as set forth in claim 1 wherein said outer shell includes heat transfer fins defining channels at least on said opposed surface of said housing, said heat transfer fins adapted to receive air flow in a manner such that said heat transfer fins direct air flow into channels between said heat transfer fins.

5. The housing as set forth in claim 4 wherein heat transfer fins are defined on said side surfaces of said outer shell.

6. The housing as set forth in claim 5 wherein said heat transfer fins defined on said side surfaces are integrally joined with said heat transfer fins on said opposed surface and aligned therewith.

* * * * *